US008905717B2

(12) United States Patent
Roman-Morales et al.

(10) Patent No.: US 8,905,717 B2
(45) Date of Patent: Dec. 9, 2014

(54) TURBINE BUCKET LOCKWIRE ROTATION PREVENTION

(75) Inventors: Felipe Roman-Morales, Simpsonville, SC (US); Ariel Caesar Prepena Jacala, Travelers Rest, SC (US); Liming Xu, Simpsonville, SC (US); Melbourne James Myers, Duncan, SC (US); Kevin Leon Bruce, Greer, SC (US); Luke John Ammann, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 586 days.

(21) Appl. No.: 12/899,305

(22) Filed: Oct. 6, 2010

(65) Prior Publication Data

US 2012/0087798 A1 Apr. 12, 2012

(51) Int. Cl.

*F01D 5/02* (2006.01)
*F01D 5/30* (2006.01)
*F01D 5/32* (2006.01)

(52) U.S. Cl.

CPC ..... *F01D 5/326* (2013.01); *F01D 5/3007* (2013.01)
USPC ..... 416/220 R; 416/204 A

(58) Field of Classification Search

USPC ..... 416/215, 218, 219 R, 220 R, 221, 220 A, 416/204 A, 248
See application file for complete search history.

(56) References Cited

U.S. PATENT DOCUMENTS 2,713,991 A 7/1955 Secord et al.
2,890,069 A 4/1956 Larkin et al.
2,873,088 A * 2/1959 Neumann ..... 416/194
3,076,634 A 6/1960 Boyle et al.
2,971,743 A 2/1961 Welsh
3,383,095 A 9/1967 Anderson
3,632,228 A 1/1972 Acres
3,832,092 A 8/1974 Manharth
3,936,234 A 2/1976 Tucker et al.
4,221,542 A * 9/1980 Acres et al. ..... 416/220 R
4,349,318 A 9/1982 Libertini et al.
4,432,555 A 2/1984 Langley
4,470,756 A 9/1984 Rigo et al.

(Continued)

FOREIGN PATENT DOCUMENTS

DE 10 2006 054 154 5/2008
EP 1 840 338 10/2007

(Continued)

OTHER PUBLICATIONS

European Search Reported cited in EP 11 18 3738, completed Jul. 4, 2014.

*Primary Examiner* — Edward Look
*Assistant Examiner* — Christopher J Hargitt
(74) *Attorney, Agent, or Firm* — Nixon & Vanderhye P.C.

(57) ABSTRACT

A retention system for a plurality of turbine buckets located in respective mating slots in a turbine rotor wheel includes a plurality of first circumferentially-oriented retention slots formed in outer peripheral portions of the turbine wheel; a plurality of second circumferentially-oriented retention slots formed in wheel mounting portions of said buckets, the first and second circumferentially-oriented retention slots aligned to form an annular lockwire retention slot; and a lockwire located within the annular lockwire retention slot. A first surface feature on one or both of the turbine rotor wheel and one or more of said plurality of turbine buckets is adapted to engage a second surface feature on the lockwire for preventing rotation of the lockwire beyond predetermined limits.

20 Claims, 7 Drawing Sheets

(56) References Cited

U.S. PATENT DOCUMENTS

| | | | | |
|---|---|---|---|---|
| 4,470,757 | A | 9/1984 | Vollinger | |
| 4,566,857 | A * | 1/1986 | Brumen | 416/220 R |
| 4,778,342 | A | 10/1988 | Conlow | |
| 4,797,065 | A | 1/1989 | Conlow | |
| 5,281,098 | A | 1/1994 | Glynn et al. | |
| 5,302,086 | A | 4/1994 | Kulesa et al. | |
| 5,727,927 | A | 3/1998 | Luxenburger | |
| 5,984,639 | A | 11/1999 | Gekht et al. | |
| 6,488,473 | B1 | 12/2002 | Lee et al. | |
| 7,090,468 | B2 | 8/2006 | Brueckner | |
| 7,264,448 | B2 | 9/2007 | Garner | |
| 8,210,823 | B2 * | 7/2012 | Ward et al. | 416/220 R |

FOREIGN PATENT DOCUMENTS

| | | |
|---|---|---|
| FR | 2 524 933 | 10/1983 |
| FR | 2 729 709 | 7/1996 |
| GB | 894704 | 4/1962 |
| WO | 2010/067024 | 6/2010 |

* cited by examiner

TURBINE BUCKET LOCKWIRE ROTATION PREVENTION

BACKGROUND OF THE INVENTION

The invention relates to a retention system used to prevent axial movement of a turbine bucket dovetail in a corresponding dovetail slot in a turbine rotor wheel, and more specifically, to techniques for preventing circumferential rotation of the axial retention system. This retention system typically takes the form of a lockwire within an annular slot or groove in the turbine rotor wheel.

In conventional turbine and/or turbine compressor components, buckets (or blades, or airfoils) are held in a rotor wheel by means of a slotted connection, e.g., a so-called "fir tree" or "Christmas tree" arrangement where an inwardly-tapered male connector portion at the radially inner end of the bucket is received in a complementary female slot in the rotor wheel. Such connections are also generically referred to as "dovetail" connections, embracing various complementary shapes which lock the buckets to the wheel in the radial and circumferential directions so as to accommodate the high centrifugal forces generated by rotation of the turbine rotor.

The fit between the blade dovetail and the dovetail slot is sufficiently loose to allow for assembly and tolerances. Centrifugal loading above a certain threshold speed effectively locks up the bucket in the wheel due to the contact forces and friction. However, operation at low speed, during which the blades are able to rock inside the dovetail, can have the tendency to make the blade move along the dovetail in the absence of axial retention. If the blade is not properly retained, the eventual likely outcome is a collision with neighboring stationary components. Before such collision can take place however, the axial movement along the dovetail could effectively block cooling flow into the blade. In the absence of the cooling flow, oxidation erosion will wear away the leading edge of the blade. An additional consequence, therefore, is unplanned machine down-time and maintenance resulting from varying degrees of machine performance deterioration up to blade separation and resulting collateral or domestic object damage.

In accordance with usual design practice, the buckets or blades are prevented from moving axially in the dovetail slots provided in the rotor wheel by a retention device, hereafter called a "lockwire", passing through an annular slot formed in the radially outer periphery of the wheel and passing through circumferentially-aligned slots in the dovetail portions of the respective buckets. The free ends of the wire are shaped so that they come together at an overlapped joint, thus allowing for minor changes in length and diameter of the lockwire as the rotor wheel, rotor wheel slots and buckets expand and contract during transient periods. The lockwire is held in place by the radial spring force stemming from installation of a relatively larger-diameter lockwire in a relatively smaller-diameter annular slot, and pins mounted in the turbine wheel, radially inwardly of the lockwire. It has been discovered that rotation of the lockwire within the annular slot in the rotor wheel (which occurs over time) can cause the free ends of the lockwire to separate at the overlap joint so that one end of the lockwire may engage a pin and bend downwardly (radially inwardly) below the pin and, thus permit the lockwire to escape the annular slot.

Without the lockwire, the airfoils are free to travel axially along the dovetail slots, creating the potential for excessive wear and interference as mentioned above. In addition, this is especially consequential in first and second stage buckets that rely on holes in the base of the bucket to provide internal cooling. When these holes are blocked due to axial movement of the bucket, cooling air cannot reach the target area and the bucket can quickly oxidize along the leading edge.

There remains a need for a reliable technique for preventing circumferential rotation of the lockwire within its annular slot to thereby prevent escape of the lockwire from the rotor wheel by preventing rotation of the lockwire.

BRIEF DESCRIPTION OF THE INVENTION

In one exemplary but nonlimiting embodiment, the invention relates to a retention system for a plurality of turbine buckets located in respective mating slots in a turbine rotor wheel, the retention system comprising a plurality of first circumferentially-oriented retention slots formed in outer peripheral portions of the turbine wheel; a plurality of second circumferentially-oriented retention slots formed in wheel mounting portions of the buckets, the first and second retention slots aligned to form an annular lockwire retention slot; a lockwire located within the annular lockwire retention slot, the lockwire having free ends; a first surface feature on one or both of the turbine rotor wheel and one or more of the plurality of turbine buckets; and a second surface feature on the lockwire adapted to engage with the first surface feature on one or both of the turbine rotor wheel and one or more of the plurality of turbine buckets for preventing circumferential rotation of the lockwire beyond predetermined limits.

In a second exemplary but nonlimiting embodiment, the invention relates to a retention system for a plurality of turbine buckets located in respective mating slots in a turbine rotor wheel, the retention system comprising a plurality of first circumferentially-oriented retention slots formed in outer peripheral portions of the turbine wheel; a plurality of second circumferentially-oriented retention slots formed in wheel mounting portions of the buckets, the first and second retention slots aligned to form an annular lockwire retention slot; a lockwire located within the annular lockwire retention slot, the lockwire having free ends; at least one axially-oriented surface feature provided on the rotor wheel or on one or more of the plurality of buckets for holding the lockwire in the annular retention slot; and at least one radially extending surface feature on the lockwire engageable with the at least one axially-oriented surface feature for preventing circumferential rotation of the lockwire beyond predetermined limits.

In still another nonlimiting aspect, the invention relates to a retention system for a plurality of turbine buckets located in respective mating slots in a turbine rotor wheel, the retention system comprising a plurality of first circumferentially-oriented retention slots formed in outer peripheral portions of the turbine wheel; a plurality of second circumferentially-oriented retention slots formed in wheel mounting portions of the buckets, the first and second retention slots aligned to form an annular lockwire retention slot; a lockwire located within the annular lockwire retention slot, the lockwire having free ends; at least one surface feature provided on the rotor wheel or on one or more of the plurality of buckets for holding the lockwire in the annular retention slot; and at least one axially-extending surface feature on the lockwire engageable with the at least one surface feature on the rotor wheel or on one or more of the plurality of buckets for preventing circumferential rotation of the lockwire beyond predetermined limits.

The invention will now be described in detail in connection with the drawings identified below.

DETAILED DESCRIPTION OF THE INVENTION

Figure 1:
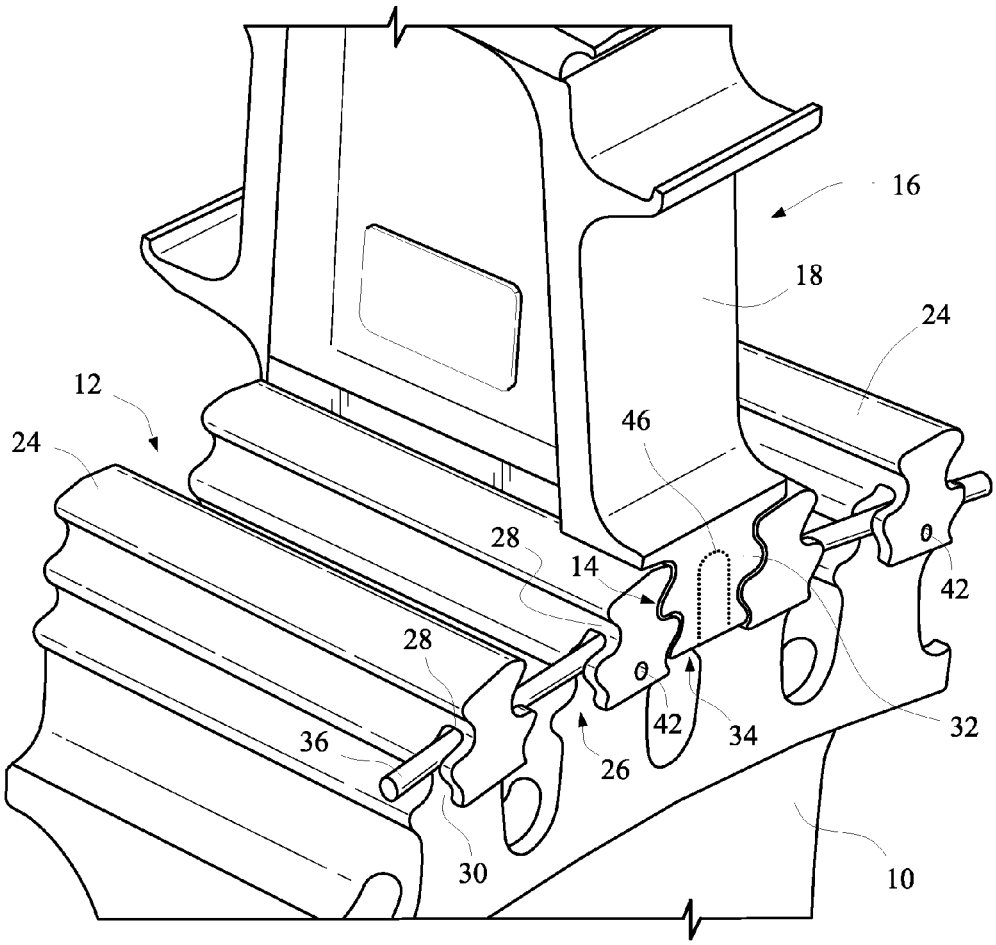
FIG. 1 is a partial top perspective view of a known turbine rotor wheel and bucket assembly showing a lockwire in place.
Figure 2:
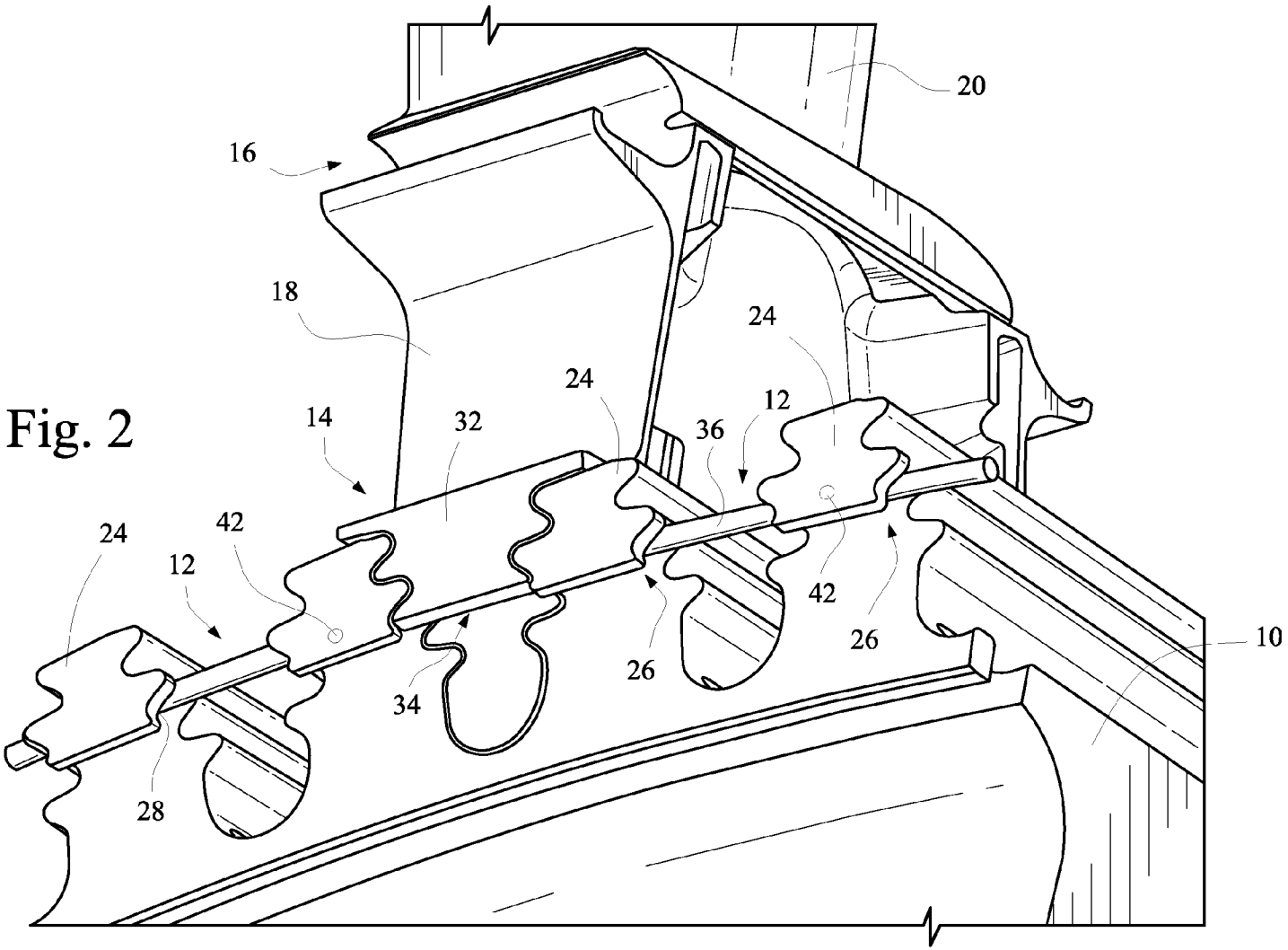
FIG. 2 is a partial bottom perspective view of the rotor wheel and bucket assembly shown in FIG. 1.

FIGS. 1 and 2 illustrate one technique for preventing axial movement of a turbine bucket received within a slot in a turbine rotor wheel. More specifically, the turbine rotor wheel 10 is formed with a plurality of dovetail slots 12 about the entire outer periphery of the wheel, each dovetail slot 12 receiving a complementary dovetail portion 14 of a bucket or blade 16 (only three complete slots and one bucket shown in the Figures). It will be understood that the bucket or blade 16 is of conventional construction, including a shank portion 18, an airfoil portion 20 and the dovetail portion (or simply, dovetail) 14.

The radially projecting portions 24 of the wheel which define the slots 12 are formed with first lockwire slots 26, each closed at its radially outer end 28 and open at its radially inner end 30. The first lockwire slots 26 are formed adjacent to one side of the wheel, and together, form an annular 360° slot about the periphery of the wheel, interrupted by the dovetail slots 12. Axially offset portions (or lock tabs) 32 of the bucket dovetails 14 define a plurality of second lockwire slots 34 that are alignable with the first lockwire slots 26 upon introduction of the buckets 16 into the dovetail slots 12. A lockwire 36 (preferably a suitable metal alloy) may then be introduced into the aligned lockwire slots 26, 34 with free ends 38, 40 shaped (e.g., reduced to a semi-circular cross section) to smoothly overlap each other along opposed surfaces 39, 41 in a normally-installed condition (FIG. 3), recognizing that the opposed surfaces are substantially flat when the lockwire is uncoiled and arcuate when installed in the annular slots 26, 34. The lockwire itself may be a single strand or multiple connected or overlapping segments. Axially-oriented retaining pins 42 inserted through the portions of the rotor wheel 10 are employed to hold the lockwire 36 within the lockwire slots 26 (FIGS. 1 and 2).

Figure 4:
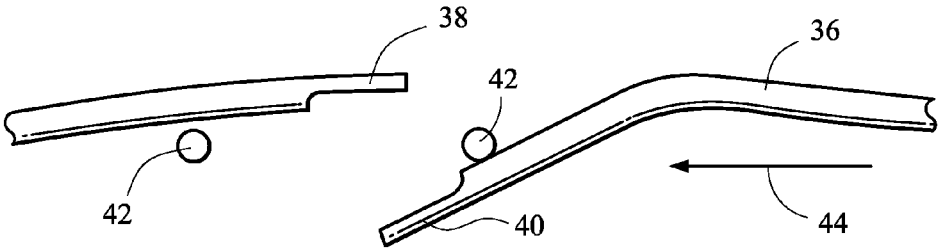
FIG. 4 is a schematic representation of separated free ends of a lockwire, with one end trapped below a retaining pin.

FIG. 4 illustrates a problem experienced with the lockwire configuration as described above. Specifically, it has been found that the lockwire 36 is prone to circumferential rotation during turbine operation due perhaps to thermal and/or mechanical ratcheting. Resulting separation of the free ends 38, 40 of the lockwire can result in one end (the trailing end in the direction of lockwire rotation) travelling below (i.e., radially inwardly) of one of the pins 42 so that during lockwire rotation in the direction shown by arrow 44, the lockwire 36 may escape the lockwire slots 26, 34, thereby permitting axial movement of the buckets 16 within the dovetail slots 12.

Figure 5:
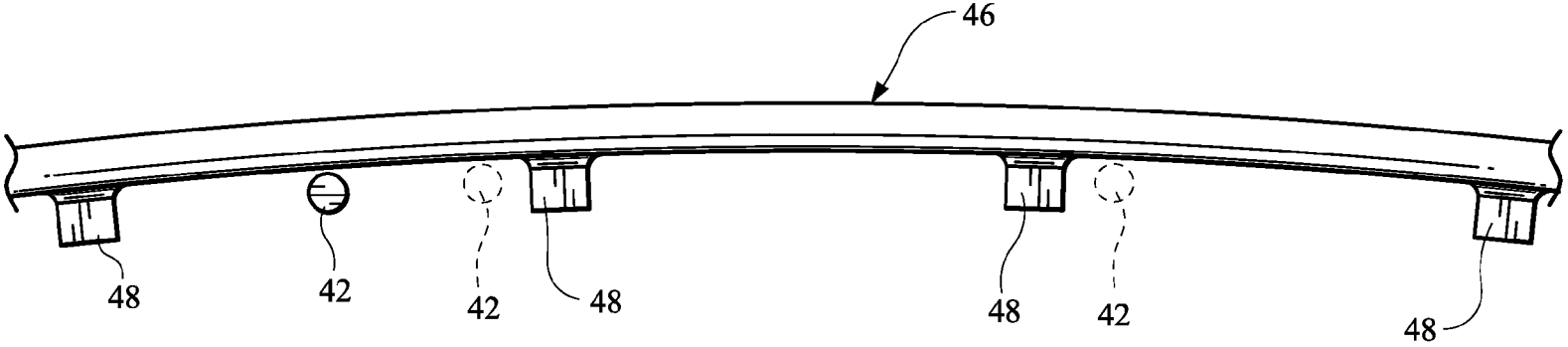
FIG. 5 is a partial perspective view of an annular lockwire fitted with radially-inwardly extending anti-rotation tabs in accordance with an exemplary but nonlimiting embodiment of the invention.
Figure 6:
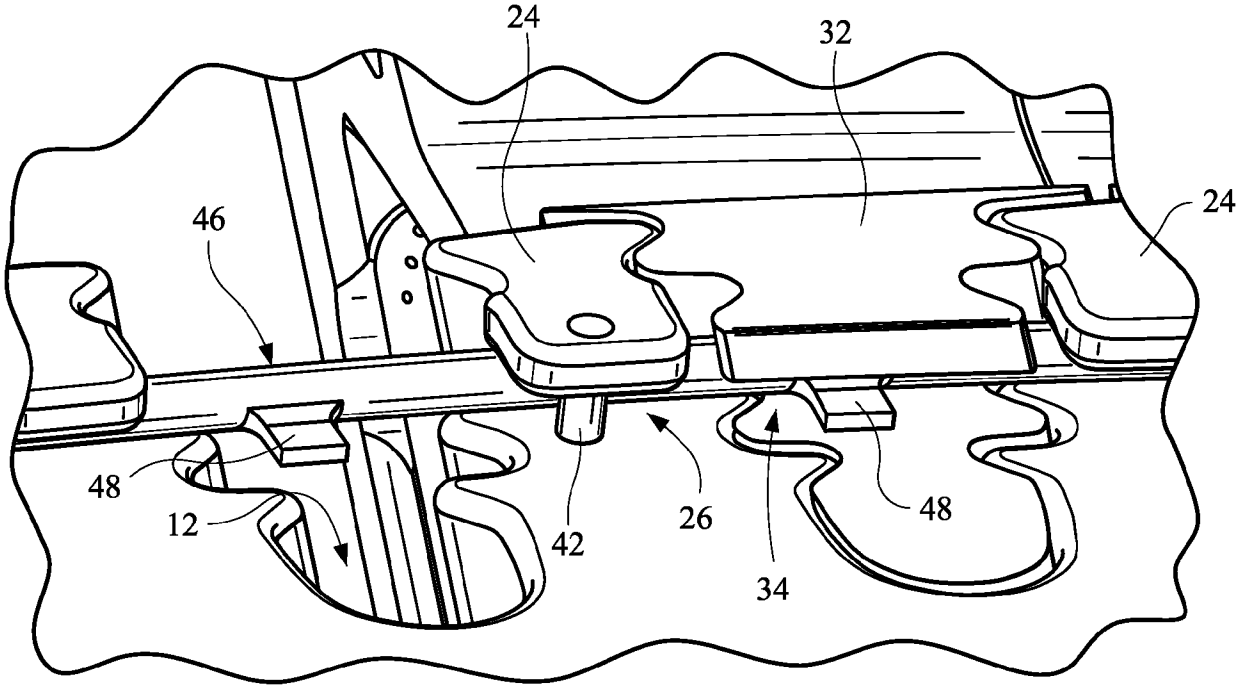
FIG. 6 is a partial perspective view of a rotor wheel with the lockwire of FIG. 5 installed.

FIGS. 5 and 6 illustrates an exemplary but nonlimiting embodiment of a lockwire 46 (or other equivalent surface feature) provided with radially inwardly extending tabs 48 for substantially preventing excessive circumferential rotation of the lockwire 46 when installed in the lockwire slots 26, 34 (FIG. 6), as described further below. The end result is that the inner and outer free ends (similar to free ends 38, 40 in FIG. 3 but not shown in FIG. 4), of the lockwire 46 are prevented from excessive circumferential rotation which might otherwise lead to one free end moving below or radially inward of the retaining pins 42 as shown in FIG. 4.

Figure 3:
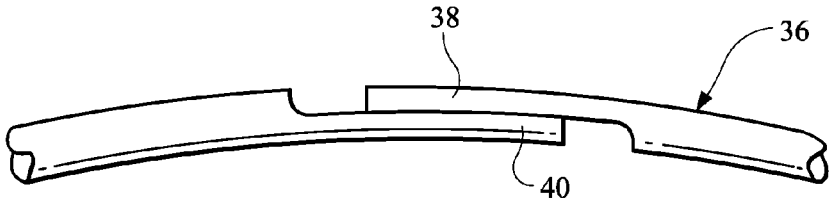
FIG. 3 is a partial elevation view of overlapped free ends of a lockwire.
Figure 3A:
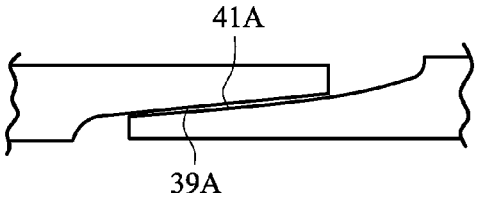
FIG. 3A is similar to FIG. 3 but illustrates an alternative lockwire design formed with tapered free ends.

The lockwire 46, like the lockwire 36, may have a round cross section with an appropriately chosen diameter, and the free ends 36, 38 are each also reshaped to a smaller cross section (e.g., semi-circular) than the remaining major length of the lockwire to provide an overlap region of substantially the same profile as the remainder of the lockwire, with the free ends engaged along opposed substantially flat, circumferentially (or horizontally)-oriented surfaces as shown in FIG. 3. The opposed surfaces at the overlap may also be wedge-shaped or tapered as shown at 39A and 41A in FIG. 3A. The ends of the lockwire 46 may also be formed on a slightly larger diameter than the remainder of the lockwire, which is otherwise formed to substantially match the diameter of the lockwire slot. This results in a tighter engagement of the overlapped free ends.

The lockwire 46 may also be formed with other cross-sectional shapes such as oval, elliptical, semi-circular or other suitable shape.

The lockwire 46 is provided with at least one and preferably between 2 and 4 or more of the radially extending tabs 48 having thicknesses less than the diameter of the lockwire. For example, lockwire diameters of 0.188", 0.250", and 0.300" may have tab thicknesses of substantially half the given diameters. The length, width, thickness and shape of the tabs 48 (or other functionally equivalent surface features added to the lockwire) may vary depending on specific applications as dictated by the available space or load carrying capability required by the intended application. In most cases, the size of the tabs 48 (or other surface features) will be the minimum size that performs the desired function, i.e., stopping any undesirable (i.e., excessive) circumferential rotation of the lockwire by engagement of the tabs (or other surface features) with respective, next-adjacent retaining pins.

Figure 5A:
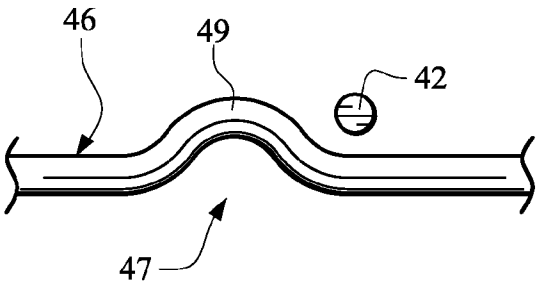
FIG. 5A is a schematic view of an alternative, nonlimiting lockwire configuration where a local deformation serves as an anti-rotation tab.

The anti-rotation tabs 48 are preferably welded or brazed to the lockwire, but the invention is not limited to any particular securement or forming technique. For example, the tabs 48 or other surface features may be attached to the lockwire by casting, forging, welding, brazing, or by any other suitable mechanical attachment. The tabs may also be in the form of sheet material bent about the lockwire and secured by any of the above techniques. The tabs may also be machined or otherwise made integral with the wire. The "tab" may also be formed by one or more local deformations in the lockwire. One example is shown in FIG. 5A, where a bend 47 creates a tab 49 that will engage the pin 42 in a manner similar to the tab 48. In addition, the number and location of the tabs (or other surface features) relative to the retaining pins may vary. For example, FIG. 4 shows a retaining pin 42 circumferentially between a pair of radially inwardly extending tabs 48 so that rotation in either direction will be halted when the pin 42 is engaged by one of the tabs 48. While some rotation of the lockwire is permitted to accommodate, for example thermal growth, circumferential rotation beyond predetermined limits is prevented. It is also possible to mount the tabs 48 such that two tabs 48 lie, respectively, on opposite sides of two adjacent pins 42 (see the dotted line pins 142 to the outside of adjacent tabs 48). The number of tabs 48 (or other surface features) on the lockwire may vary between one and more than four, but it is preferable (but not required) that the tabs or other surface features be located substantially mid-way between the free ends of the lockwire. In addition, the pins 42 need not be of the shape illustrated in the drawings. Other axially extending surface features on the rotor wheel or in the buckets may be used to engage one or more of the tabs 48 or other surface features on the lockwire to prevent circumferential rotation of the lockwire.

Figure 6A:
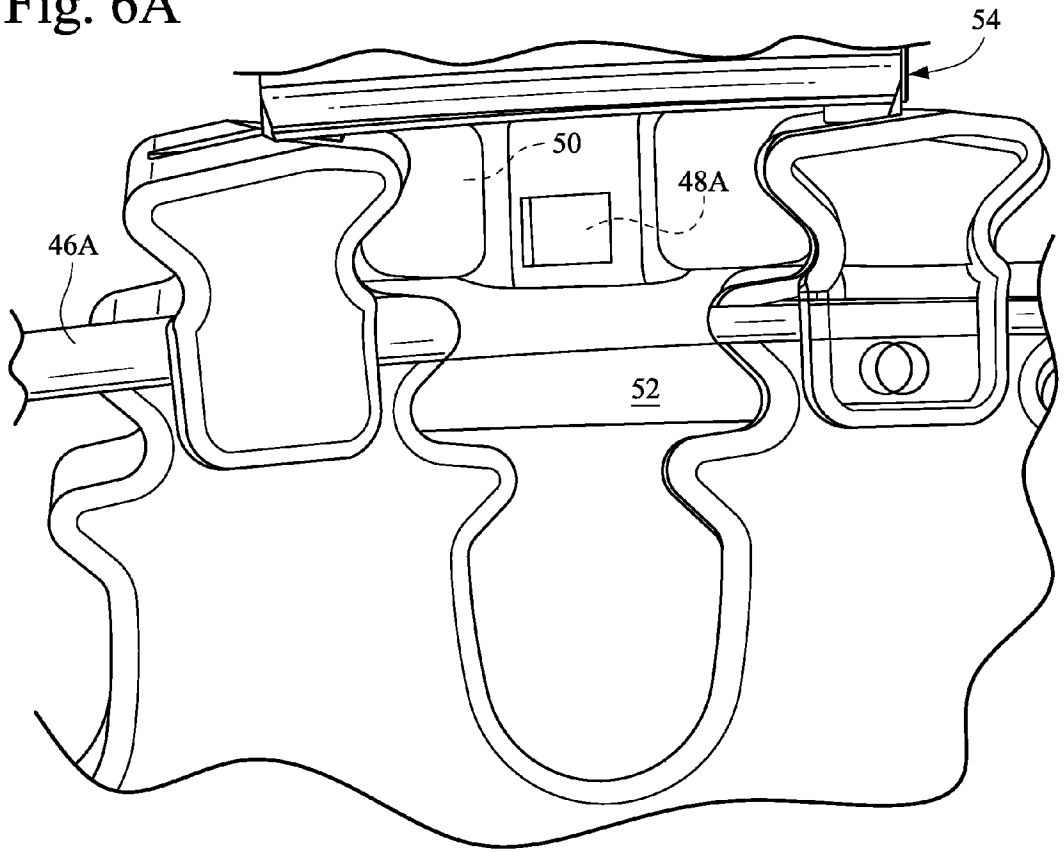
FIG. 6A is a partial elevation in transparent format, illustrating an alternative but nonlimiting embodiment where the anti-rotation tabs extend radially outwardly of the lockwire.

It will be appreciated that the tabs 48 (or other surface features) may also extend radially outwardly of the lockwire, as illustrated, for example, in FIG. 6A. FIG. 6A is a transparency showing a tab 48A extending radially outwardly of the lockwire 46A, and received in an opening 50 formed in the dovetail portion 52 of the bucket 54.

Figure 7:
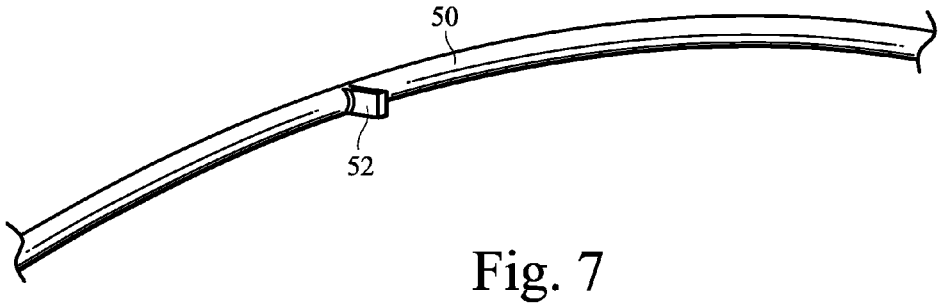
FIG. 7 is a perspective view of a lockwire fitted with axially-extending anti-rotation tabs in accordance with another exemplary but nonlimiting embodiment of the invention.
Figure 8:
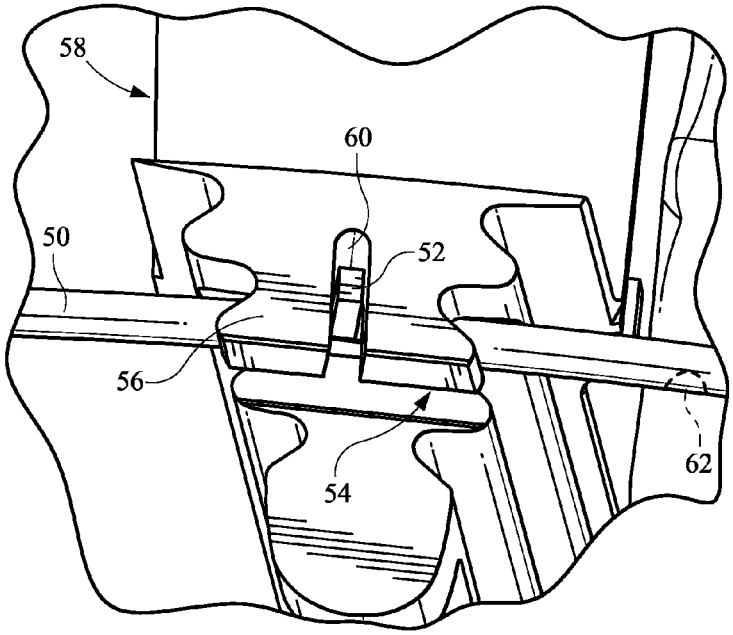
FIG. 8 is a partial perspective view of the lockwire of FIG. 7 installed within a bucket lockwire slot.

It is also within the scope of the invention to have axially extending tabs or other surface features on the lockwire that, upon minimal rotation of the lockwire, will engage a hole or slot or other surface feature formed in the adjacent slot wall of the bucket or turbine wheel. For example, FIG. 7 illustrates a lockwire 56 provided with one or more axially-extending tabs 58 sized, shaped and located to engage a hole, slot or other surface feature provided in the rotor wheel or bucket. FIG. 8 shows one example where the lockwire 56 of FIG. 7 is installed in the annular groove 60 (shown only with respect to the single bucket 62) such that the axially-extending tab 58 is loosely received within a radially extending slot 64 formed in the bucket dovetail 66 that opens into the annular groove 60. In this way, the lockwire 56 is prevented from excessive circumferential rotation that might otherwise allow escape of the lockwire 56 from the annular slot or groove 60. It will be appreciated that the axially-extending tab (or other surface feature) 58 may also vary in size, shape and number as described above in connection with the tab(s) 48, and that the tab 58 may extend axially from either side of the lockwire depending on the location of a hole, groove, notch or other surface feature within the annular or circumferential slot or groove 60 in the bucket (or turbine wheel) with which it cooperates to prevent circumferential rotation of the lockwire.

In all cases, the amount of lockwire rotation is limited to the extent that separation of the overlapped free ends of the lockwire is precluded.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A retention system for a plurality of turbine buckets located in respective mating slots in a turbine rotor wheel, the retention system comprising:

a plurality of first circumferentially-oriented retention slots formed in outer peripheral portions of the turbine wheel;

a plurality of second circumferentially-oriented retention slots formed in wheel mounting portions of said buckets, said first and second retention slots aligned to form an annular lockwire retention slot;

a lockwire located within said annular lockwire retention slot, said lockwire having free ends;

a first surface feature and a third surface on one or both of said turbine rotor wheel and one or more of said plurality of turbine buckets, wherein the first and third surface features protrude into one or more of the first and second retention slots and the first and third surfaces are separated by a certain distance along the retention slots; and a second surface feature on said lockwire adapted to engage with said first and third surface features on one or both of said turbine rotor wheel and one or more of said plurality of turbine buckets so as to permit circumferential rotation of said lockwire within the certain distance and to prevent circumferential rotation beyond said certain distance during operation of a turbine including the turbine wheel.

2. The retention system of claim 1 wherein said first and third surface features on one or both of said turbine rotor wheel and one or more of said plurality of turbine buckets comprise a plurality of axially-extending pins.

3. The retention system of claim 1 wherein said second surface feature on said lockwire comprises at least one axially-extending tab.

4. The retention system of claim 3 wherein said at least one axially-extending tab is attached to, or made integral with said lockwire.

5. The retention system of claim 1 wherein said second surface feature on said lockwire comprises at least one radially-extending tab.

6. The retention system of claim 1 wherein said second surface feature on said lockwire comprises at least one anti rotation element attached to said lockwire.

7. A retention system for a plurality of turbine buckets located in respective mating slots in a turbine rotor wheel, the retention system comprising:

a plurality of first circumferentially-oriented retention slots formed in outer peripheral portions of the turbine wheel;

a plurality of second circumferentially-oriented retention slots formed in wheel mounting portions of said buckets, said first and second retention slots aligned to form an annular lockwire retention slot;

a lockwire located within said annular lockwire retention slot, said lockwire configured to set in the first and second retention slots;

at least one axially-oriented surface feature provided on said rotor wheel or on one or more of said plurality of buckets and protruding into said annular retention slot; and a pair of protruding surface features on said lockwire engageable with said at least one axially-oriented surface feature for enabling circumferential rotation of said lockwire, wherein the circumferential rotation is limited to a distance between the pair of surface features and wherein the engagement between the pair of surface features and the at least one axially-oriented surface features prevents circumferential rotation of said lockwire beyond the certain during operation of a turbine including the turbine wheel.

8. The retention system according to claim 7, wherein said at least one axially-oriented surface feature comprise a plurality of circumferentially-spaced pins.

9. The retention system according to claim 8, wherein said pair of surface features comprise anti-rotation tabs extending substantially radially inwardly or outwardly from said lockwire.

10. The retention system according to claim 7 wherein said pair of surface features are formed by a local deformation of said lockwire.

11. The retention system of claim 7 wherein said lockwire has a substantially circular cross section and wherein said pair of surface features each has a thickness dimension less than a diameter of said lockwire.

12. The retention system according to claim 7 wherein, when installed, said free ends of said lockwire overlap, and wherein said pair of surface features is located substantially mid-way between said free ends.

13. The retention system of claim 7 wherein said pair of surface features is attached to, or made integral with said lockwire.

14. A retention system for a plurality of turbine buckets located in respective mating slots in a turbine rotor wheel, the retention system comprising:

a plurality of first circumferentially-oriented retention slots formed in outer peripheral portions of the turbine wheel;

a plurality of second circumferentially-oriented retention slots formed in wheel mounting portions of said buckets, said first and second retention slots aligned to form an annular lockwire retention slot;

a lockwire located within said annular lockwire retention slot, said lockwire having free ends;

a first surface feature and a second surface feature each provided on said rotor wheel or on one or more of said plurality of buckets and protruding into said annular retention slot, wherein the first and third surfaces are separated by a certain distance along the retention slots; and at least one axially-extending surface feature on said lockwire engageable with said at least one surface feature on said rotor wheel or on one or more of said plurality of buckets for enabling circumferential rotation up to the certain distance of said lockwire but preventing circumferential rotation of said lockwire beyond the certain distance during operation of a turbine including the turbine wheel.

15. The retention system according to claim 14 wherein said at least one axially-extending surface feature on said lockwire comprises one or more tabs extending axially in a direction away from said turbine rotor wheel.

16. The retention system of claim 14 wherein said at least one axially-extending surface feature is attached to, or made integral with said lockwire.

17. The retention system according to claim 14, wherein said at least one axially-extending surface feature comprises one or more anti-rotation tabs extending substantially axially from said lockwire.

18. The retention system according to claim 17 wherein said at least one surface feature provided on said rotor wheel or on one or more of said plurality of buckets comprises at least one radially oriented slot.

19. The retention system of claim 14 wherein said lockwire has a substantially circular cross section and wherein said least one axially-extending surface feature has a thickness dimension less than a diameter of said lockwire.

20. The retention system according to claim 14 wherein, when installed, said free ends of said lockwire overlap.

* * * * *

UNITED STATES PATENT AND TRADEMARK OFFICE

CERTIFICATE OF CORRECTION

PATENT NO. : 8,905,717 B2
APPLICATION NO. : 12/899305
DATED : December 9, 2014
INVENTOR(S) : Roman-Morales et al.

It is certified that error appears in the above-identified patent and that said Letters Patent is hereby corrected as shown below:

In the Specification,

At column 3, line 60, insert --24-- after "through the portions"

Signed and Sealed this
Tenth Day of March, 2015

Michelle K. Lee

Michelle K. Lee
*Deputy Director of the United States Patent and Trademark Office*